US007782172B2

(12) United States Patent
Tsukada

(10) Patent No.: US 7,782,172 B2
(45) Date of Patent: Aug. 24, 2010

(54) VARIABLE CHIP RESISTOR

(75) Inventor: Torayuki Tsukada, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 91 days.

(21) Appl. No.: 11/991,681

(22) PCT Filed: Sep. 4, 2006

(86) PCT No.: PCT/JP2006/317444

§ 371 (c)(1),
(2), (4) Date: Mar. 7, 2008

(87) PCT Pub. No.: WO2007/029639

PCT Pub. Date: Mar. 15, 2007

(65) Prior Publication Data

US 2009/0096570 A1 Apr. 16, 2009

(30) Foreign Application Priority Data

Sep. 7, 2005 (JP) ..... 2005-259499

(51) Int. Cl.
*H01C 10/00* (2006.01)

(52) U.S. Cl. ..... 338/195; 338/87

(58) Field of Classification Search ..... 338/195, 338/114, 120, 68, 87, 317, 202
See application file for complete search history.

(56) References Cited

U.S. PATENT DOCUMENTS

| | | | | |
|---|---|---|---|---|
| 4,001,759 | A * | 1/1977 | Bailey | 338/68 |
| 4,163,204 | A * | 7/1979 | Sado et al. | 338/114 |
| 4,627,303 | A * | 12/1986 | Hirose | 74/425 |
| 6,107,612 | A * | 8/2000 | Farant | 219/529 |
| 2005/0200451 | A1 | 9/2005 | Tsukada | |

FOREIGN PATENT DOCUMENTS

| | | |
|---|---|---|
| JP | 59-29754 | 2/1984 |
| JP | 61-203517 | 12/1986 |
| JP | 63-77106 | 4/1988 |
| JP | 2004-22658 | 1/2004 |

OTHER PUBLICATIONS

International Search Report from the corresponding PCT/JP2006/317444, mailed Nov. 21, 2006.

* cited by examiner

*Primary Examiner*—Kyung Lee
(74) *Attorney, Agent, or Firm*—Hamre, Schumann, Mueller & Larson, P.C.

(57) ABSTRACT

A variable chip resistor (1) of the present invention includes a resistor element (2) made of a metal plate which is in the form of a chip and has a predetermined specific resistance. Terminal electrodes (3, 4) for soldering are provided at both ends of the resistor element (2), and at least one adjustment hole (9) is formed in the resistor element (2) at a portion between the terminal electrodes (3, 4). An adjustment rod (10) is inserted into the adjustment hole (9) in close contact with the inner surface of the adjustment hole. The adjustment rod (10) is made of an electroconductive material, and its insertion depth is adjustable in the axial direction of the adjustment hole (9).

5 Claims, 3 Drawing Sheets

VARIABLE CHIP RESISTOR

TECHNICAL FIELD

The present invention relates to a chip resistor using a metal plate to have a low resistance, in particular, to a variable chip resistor whose resistance is adjustable.

BACKGROUND ART

As disclosed in Patent Document 1, a conventional chip resistor, using a metal plate to have a low resistance, includes a chip-shaped resistor element made of a metal plate having a desired specific resistance, and the terminal electrodes for soldering are provided on both ends of the resistor element.

Patent Document 1: JP-A-2004-22658

The total resistance of the chip resistor having this structure is determined by the specific resistance of the metal material, the length between the opposite terminal electrodes of the resistor element, and the thickness and width of the resistor element.

In the chip resistor of the Patent Document 1, the resistor element is formed with a trimming groove. By the provision of the trimming groove, the total resistance of the chip resistor is adjusted to a predetermined value (hereinafter referred to as "trimming adjustment"). However, the work of trimming is troublesome. Further, the total resistance cannot be changed after the trimming adjustment.

DISCLOSURE OF THE INVENTION

An object of the present invention is to provide a variable chip resistor whose total resistance is adjustable with a simple arrangement.

To achieve the technical object, according to the present invention in one aspect, there is provided a variable chip resistor comprising: a chip-shaped resistor element made of a metal plate having a predetermined specific resistance; and terminal electrodes for soldering provided at both ends of the resistor element. The chip resistor further comprises at least one adjustment hole formed in the resistor element at a portion between the terminal electrodes, and an electroconductive adjustment rod inserted into the adjustment hole in close contact with the inner surface of the adjustment hole. The insertion depth of the rod is adjustable in an axial direction of the adjustment hole.

According to another aspect of the present invention, in the variable chip resistor as set forth above, the adjustment hole is provided at a cylindrical burring portion formed by deforming part of the resistor element to protrude into the desired shape.

According to another aspect of the present invention, in the variable chip resistor as set forth above, the inner surface of the adjustment hole is formed with an internal thread, and the adjustment rod includes an outer circumferential surface formed with an external thread for engagement with the internal thread of the adjustment hole.

According to another aspect of the present invention, in the variable chip resistor as set forth above, the adjustment rod includes a head formed with an engagement portion for engagement with a screwdriver, and a spring washer is interposed between the head of the adjustment rod and the resistor element.

According to another aspect of the present invention, in the variable chip resistor as set forth above, the adjustment rod comprises a tapping screw to form an internal thread on the inner surface of the adjustment hole by the external thread on the outer circumferential surface of the screw.

According to another aspect of the present invention, in the variable chip resistor as set forth above, the adjustment rod is made of a material having a specific resistance lower than the specific resistance of the resistor element.

BEST MODE FOR CARRYING OUT THE INVENTION

Preferred embodiments of the present invention will be described below with reference to the accompanying drawings.

Figure 1:
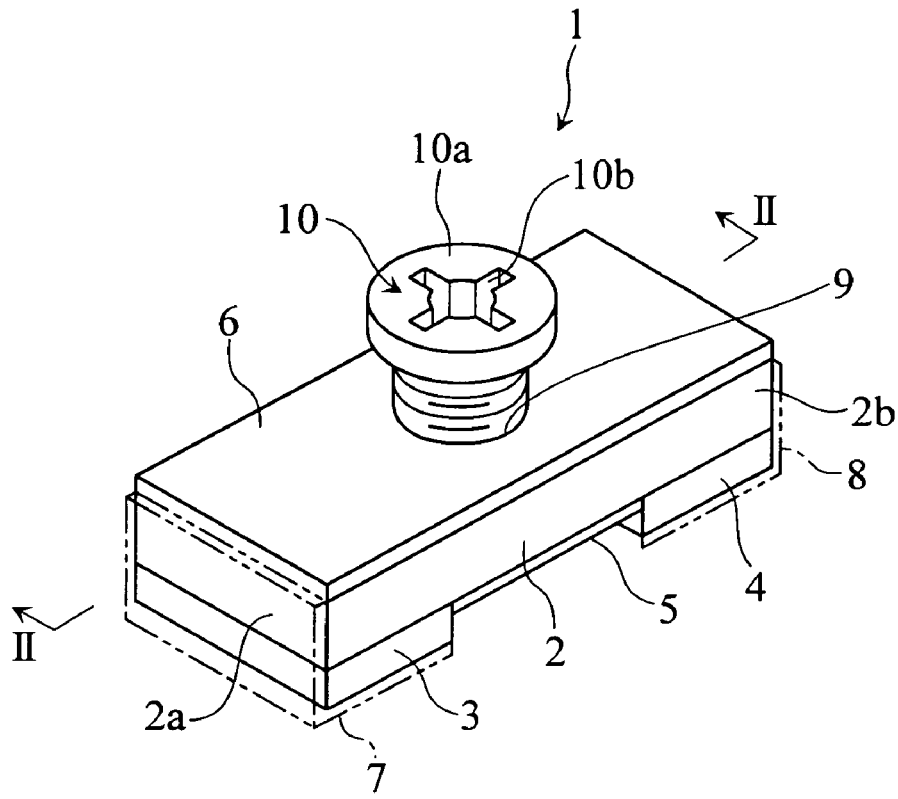
FIG. 1 is a perspective view showing a first embodiment of the present invention.
Figure 2:
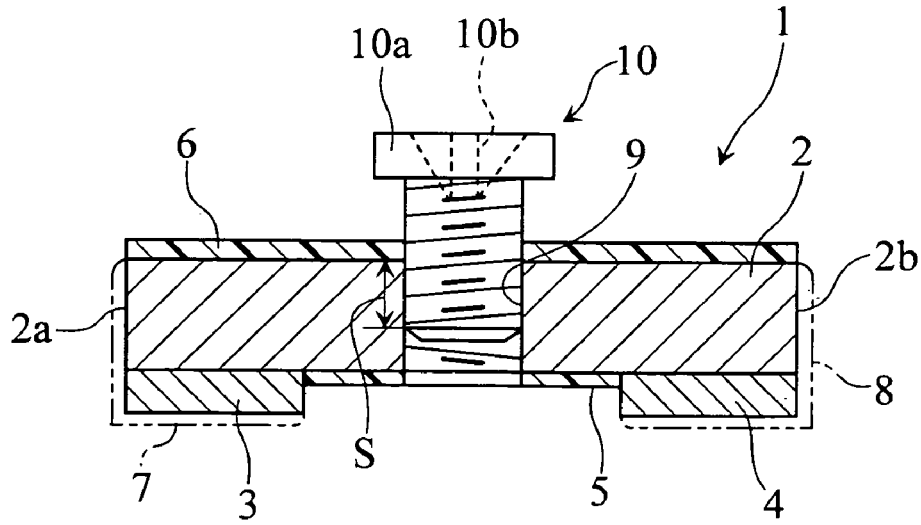
FIG. 2 is a sectional view taken along lines II-II in FIG. 1.

FIGS. 1 and 2 show a chip resistor 1 according to a first embodiment of the present invention. The chip resistor 1 includes a resistor element 2, terminal electrodes 3 and 4, insulating films 5 and 6, solder plating layers 7 and 8, an adjustment hole 9 and an adjustment rod 10.

The resistor element 2 comprises a metal plate in the form of a chip having an appropriate specific resistance. (In the example shown in FIG. 1, the resistor element is in the form of a thin rectangular strip elongated laterally in plan view.) The terminal electrodes 3 and 4 are arranged at longitudinally both ends of a surface (lower surface in FIG. 1) of the resistor element 2. The solder plating layers 7 and 8 are formed on longitudinally opposite end surfaces 2*a* and 2*b* of the resistor element 2 and the surfaces of the terminal electrodes 3 and 4. The chip resistor 1 is mounted on e.g. a printed board by soldering at the terminal electrodes 3 and 4.

The insulating film 5 is provided between the terminal electrodes 3 and 4. The insulating film 6 is provided on a surface of the resistor element 2 (upper surface in FIG. 1) which is opposite from the surface formed with the terminal electrodes 3 and 4. The insulating films 5 and 6 are heat-resistant insulating films. The resistor element 2 is protected by the insulating films 5 and 6.

The adjustment hole 9 penetrates the resistor element 2 from the upper surface side to the lower surface side between the opposite terminal electrodes 3 and 4. The adjustment rod 10 is made of a metal material having an appropriate specific resistance. The adjustment rod 10 is inserted in the adjustment hole 9 in close contact with the inner surface of the adjustment hole. The insertion depth of the adjustment rod is adjustable in the axial direction of the adjustment hole 9.

In the first embodiment, the inner surface of the adjustment hole 9 is formed with an internal thread. The outer circumferential surface of the adjustment rod 10 is formed with an external thread for engagement with the internal thread on the inner surface of the adjustment hole 9. The adjustment rod 10 is screwed into the adjustment hole 9 by bringing the external thread on the outer surface thereof into engagement with the internal thread on the inner surface of the adjustment hole 9.

The adjustment rod 10 includes a head 10*a* at the end which is not inserted in the adjustment hole 9. The head 10*a* is formed with a screwdriver engagement groove 10*b* (in the form of a cross in the example of FIG. 1) used for turning the adjustment rod 10 around the axis thereof.

The portion of the adjustment rod 10 which is inserted in the adjustment hole 9 and the resistor element 2 constitute a resistor portion. When the insertion depth S of the adjustment rod 10 in the adjustment hole 9 (hereinafter simply referred to as "insertion depth S") is increased, the cross sectional area of the resistor portion at the surface extending perpendicular to the longitudinal direction at the position of the resistor element 2 at which the adjustment hole 9 is provided (hereinafter simply referred to as "cross sectional area") increases. When the insertion depth S is reduced, the cross sectional area reduces. Thus, the total resistance between the terminal electrodes 3 and 4 reduces when the insertion depth S is increased and increases when the insertion depth S is reduced. Thus, the total resistance of the chip resistor 1 is properly changed to an intended value by adjusting the insertion depth S.

The insertion depth S can be finely adjusted by bringing a screwdriver into engagement with the engagement portion 10*b* at the head of the adjustment rod 10 and turning the adjustment rod while bringing the external thread on the outer surface of the adjustment rod into engagement with the internal thread on the inner surface of the adjustment hole 9. Thus, the total resistance of the chip resistor 1 can be changed finely with high accuracy. The change of the total resistance is possible not only in the process of manufacturing the chip resistor 1 but also after the chip resistor is mounted on a printed board.

When the specific resistance of the metal material forming the adjustment rod 10 is lower than that of the metal material forming the resistor element 2, the variation of the total resistance relative to the adjustment amount of the insertion depth S is small. In this case, the adjustment accuracy of the total resistance of the chip resistor 1 is further enhanced.

The adjustment rod 10 may comprise a tapping screw capable of forming an internal thread by the external thread formed on the outer circumferential surface thereof. Specifically, by inserting the adjustment rod 10 as a tapping screw into an adjustment hole 9 which is not formed with an internal thread, an internal thread is formed on the inner surface of the adjustment hole 9. In this case, the work of forming an internal thread on the inner surface of the adjustment hole 9 in advance is eliminated.

Figure 3:
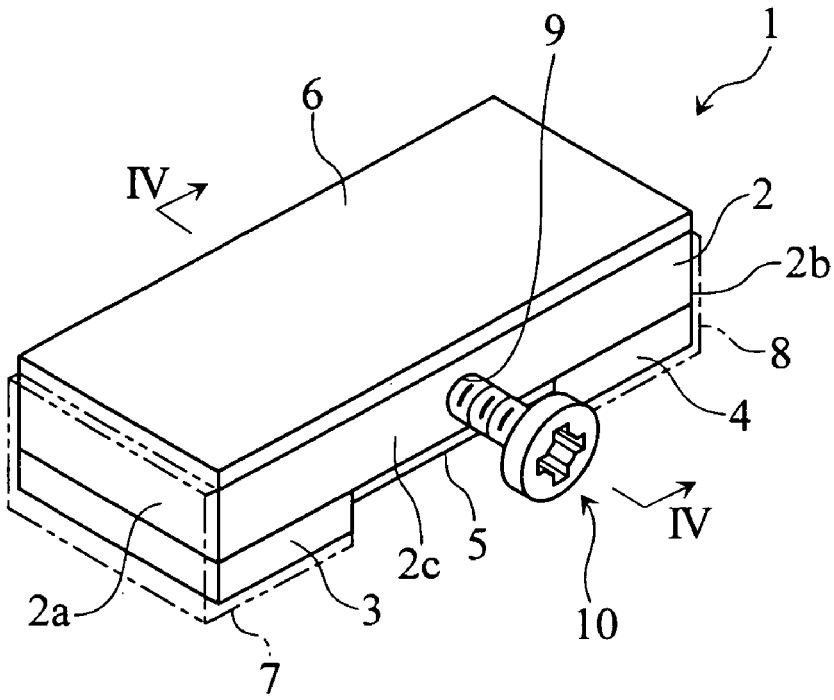
FIG. 3 is a perspective view showing a variation of the first embodiment of the present invention.
Figure 4:
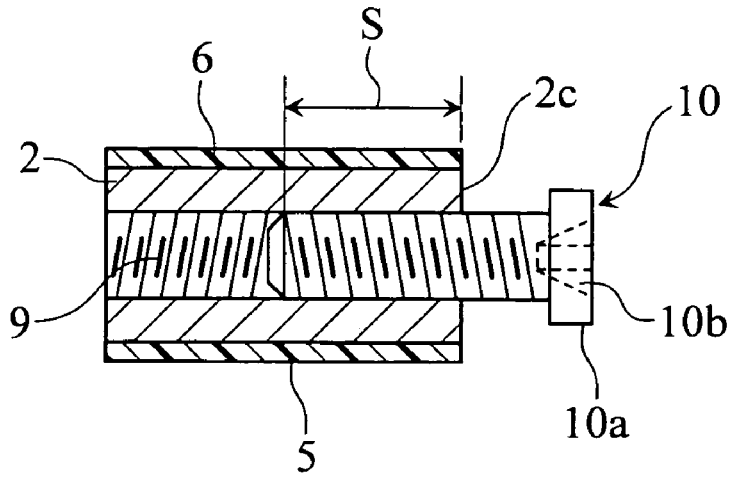
FIG. 4 is a sectional view taken along lines IV-IV in FIG. 3.

The adjustment hole 9 does not necessarily penetrate the resistor element 2 from the upper surface side to the lower surface side between the opposite terminal electrodes 3 and 4. As shown in FIGS. 3 and 4, the adjustment hole 9 may extend horizontally from one side surface 2*c* of the resistor element 2.

Figure 5:
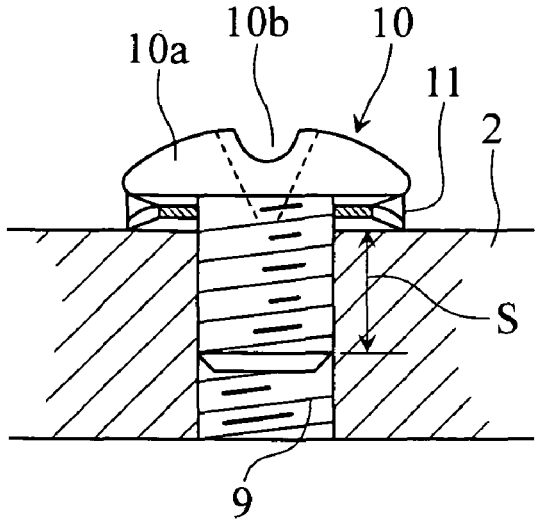
FIG. 5 shows another variation of the first embodiment of the present invention.

As shown in FIG. 5, a spring washer such as a toothed lock washer 11 may be interposed between the head 10*a* of the adjustment rod and the resistor element 2. With this arrangement, the spring washer fixes the adjustment rod 10 at a predetermined position so as not to rotate. As a result, the total resistance is reliably prevented from changing due to unintentional movement of the adjustment rod 10.

Next, an embodiment in which the thickness of the resistor element 2 is reduced will be described. The total resistance of the chip resistor 1 can be increased by reducing the thickness of the resistor element 2 of the first embodiment. However, when the thickness of the resistor element 2 is reduced, the depth of the adjustment hole 9 also reduces, which narrows the adjustment range of the insertion depth S. As a result, the variable range of the total resistance of the chip resistor 1 narrows.

Figure 6:
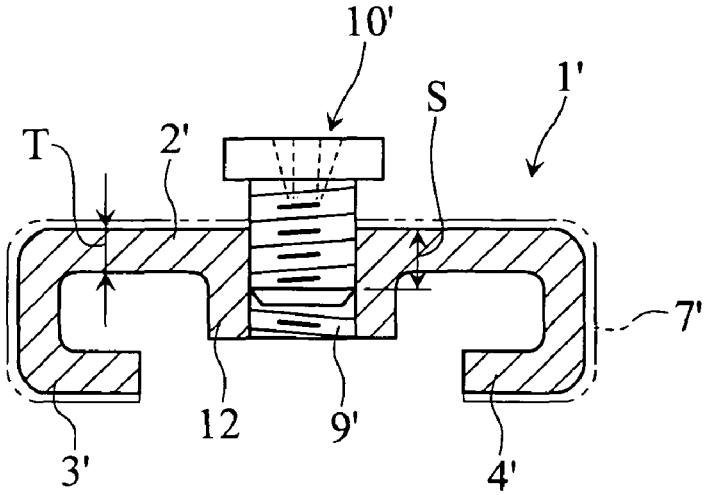
FIG. 6 is a longitudinal sectional view showing a second embodiment of the present invention.

FIG. 6 shows a chip resistor 1' according to a second embodiment of the present invention. In this chip resistor, the variable range of the total resistance is not narrowed although the resistor element is made relatively thin. The chip resistor 1' includes a resistor element 2', terminal electrodes 3' and 4', a solder plating layer 7', an adjustment hole 9' and an adjustment rod 10'.

The resistor element 2' is made of a relatively thin metal plate having an appropriate specific resistance. The terminal electrodes 3' and 4' are provided by bending the ends of the resistor element 2' in a predetermined direction (downward in FIG. 6). The solder plating layer 7' is formed on the surface of the resistor element 2' which is opposite from the terminal electrodes 3', 4' (upper surface in FIG. 6) and the surfaces of the terminal electrodes 3' and 4'.

The adjustment hole 9' is provided at a cylindrical protrusion 12 formed by burring whereby part of the resistor element 2' is deformed downward into the desired shape. The inner surface of the adjustment hole 9' is formed with an internal thread. Similarly to the first embodiment, the adjustment rod 10' is formed with an external thread so that the insertion depth of the adjustment rod is adjustable in the axial direction of the adjustment hole 9'.

According to the second embodiment, the insertion depth S of the adjustment rod 10' can be made larger than the plate thickness T of the resistor element 2'. Thus, although the resistor element 2' is made thin to increase the total resistance of the chip resistor 1', the variable range of the total resistance is kept large.

Although a single adjustment hole and a single adjustment rod are provided in a resistor element in each of the foregoing embodiments, the present invention is not limited to this structure. For instance, a resistor element may be provided with a plurality of adjustment holes and a plurality of adjustment rods.

The invention claimed is:

1. A variable chip resistor comprising:

a chip-shaped resistor element made of a metal plate having a predetermined specific resistance, the resistor element including two ends used as terminal electrodes for soldering;

at least one adjustment hole formed in the resistor element at a portion between the terminal electrodes; and an electroconductive adjustment rod inserted into the adjustment hole in close contact with an inner surface of the adjustment hole, the adjustment rod being variable in insertion depth in an axial direction of the adjustment hole;

wherein the adjustment hole is provided at a burring portion formed by deforming part of the resistor element into a cylindrical protrusion.

2. The variable chip resistor according to claim 1, wherein the inner surface of the adjustment hole is formed with an internal thread, and wherein the adjustment rod includes an outer circumferential surface formed with an external thread for engagement with the internal thread of the adjustment hole.

3. The variable chip resistor according to claim 2, wherein the adjustment rod includes a head formed with an engagement portion for engagement with a screwdriver.

4. The variable chip resistor according to claim 1, wherein the adjustment rod comprises a tapping screw to form an internal thread on the inner surface of the adjustment hole by an external thread on an outer circumferential surface of the screw.

5. The variable chip resistor according to claim 1, wherein the adjustment rod is made of a material having a specific resistance lower than a specific resistance of the resistor element.

* * * * *